United States Patent [19]

Hsieh et al.

[11] Patent Number: 4,914,360

[45] Date of Patent: Apr. 3, 1990

[54] VENETIAN BLIND CONTROLLER

[76] Inventors: Chi-Sheng Hsieh, No. 1, Lane 64, Da Lien Rd., Ping Tung; Ming Nien, Rm. C, 4th Fl., Wonderful Bldg., 101, Sec. 4, Jen Ai Rd., Taipei, both of Taiwan

[21] Appl. No.: 321,995

[22] Filed: Mar. 10, 1989

[51] Int. Cl.[4] ..... A47H 5/00

[52] U.S. Cl. ..... 318/16; 318/17; 160/167; 160/331; 160/DIG. 17

[58] Field of Search ..... 318/16, 17; 160/1, 7, 160/9, 166.1, 167, 170, 171, 172, 173, 174, 175, 176.1, 330, 331, 334, 902, 904, DIG. 17

[56] References Cited

U.S. PATENT DOCUMENTS

| | | | |
|---|---|---|---|
| 3,603,372 | 9/1971 | Dietzsch | 160/170 X |
| 4,128,307 | 12/1978 | Badertscher et al. | 160/167 X |
| 4,522,244 | 6/1985 | Brolin | 160/170 X |
| 4,618,804 | 10/1986 | Iwasaki | 318/16 |
| 4,819,708 | 4/1989 | Onosato et al. | 160/331 |
| 4,827,199 | 5/1989 | Kaucl et al. | 160/331 X |

*Primary Examiner*—Bentsu Ro

*Attorney, Agent, or Firm*—Asian Paeirk Int'l Patent & Trademark Office

[57] ABSTRACT

This invention relates to a Venetian blind controller and, more particularly to a Venetian blind controller directly attached to a Venetian blind for controlling the opening and closing of the Venetian blind and for controlling the angular position of the blades through wireless remote control operation or alternatively through manual operation during power failure without detaching the controller from the Venetian blind, of which the structure includes two magnetic clutch fitted DC motors, two guide wheels, two pressure wheels, one chain wheel, one pull rope wheel, one receiving circuit, and a remote controller.

6 Claims, 8 Drawing Sheets

VENETIAN BLIND CONTROLLER

BACKGROUND OF THE INVENTION

Venetian blind is provided for regulating the amount of outside light rays from penetrating into a house. Because it can help to immediately change indoor atmosphere to fit in with the surroundings, and because the color and pattern arrangement of Venetian blinds provide good decorative effect, Venetian blind has become a favorite in the modern indoor decoration industry.

Conventional Venetian blind includes two pull ropes, one horizontal pull rope to pull the blind blades to spread out or to retreat, and one directional pull rope to adjust the angular position of the blind blades. Normally, these two pull ropes are controlled by manual operation. To ordinary people, it is not difficult to pull the ropes to control a Venetian blind. However, it is still not convenient to hospitalized patients or any patients or the aged who live at home and are not convenient to move. More particularly, if a window is made at a high position, the associated Venetian blind is more inconvenient to operate by manual operation through the pull ropes.

In view of said problems, the present invention is created to fit the requirements for remote control. According to the present invention, the Venetian blind controller can be attached to a Venetian blind to control the opening and closing of the Venetian blind and the angular position of the blind blades through remote control operation, with its original manual operation feature maintained for alternative application during power failure.

SUMMARY OF THE INVENTION

A Venetian blind controller according to the present invention, is comprised two electromagnetic clutch fitted motors, two guide wheels, two pressure wheels, one pull rope wheel, one chain wheel, one receiver circuit, and one remote controller.

The main object of the present invention is to provide a Venetian blind controller wherein the electromagnetic clutch fitted DC motor includes a DC motor, an electromagnetic coil, and a revolving disc. The DC motor comprises an elongated shaft to penetrate through a reducing gear, an electromagnetic coil and a revolving disc. The electromagnetic coil is fixedly mounted on the DC motor, comprising a bearing at its central hole. The bearing is tightly mounted on the elongated shaft. The revolving disc is fixedly mounted on the elongated shaft by means of a pin. The revolving disc comprises a flange which is in contact with the inner surface of the electromagnetic coil. When the motor rotates, the revolving disc will be driven to rotate concomitantly. A chain wheel (or pull rope wheel) which is stuck with a ring-shaped metal plate is mounted on the elongated shaft above the revolving disc. During the rotation of the motor, if the electromagnetic coil is not energized, the revolving disc does not rotate; if the electromagnetic coil is energized, the revolving disc attracts the ring-shaped metal plate to drive the wheel to rotate.

Another object of the present invention is to provide a Venetian blind controller which may be attached to any conventional Venetian blind to control its operation.

A yet further object of the present invention is to provide a Venetian blind controller, wherein the chain wheel (or pull rope wheel) is released from the constraint of the electromagnetic coil during power failure, to freely rotate, so as to allow manual operation.

Other objects, features, and advantages of the present invention will be more apparent from the detailed description quoted on the basis of the annexed drawings as hereunder.

DETAILED DESCRIPTION OF THE PREFERRED EMBODIMENTS

Figure 1:
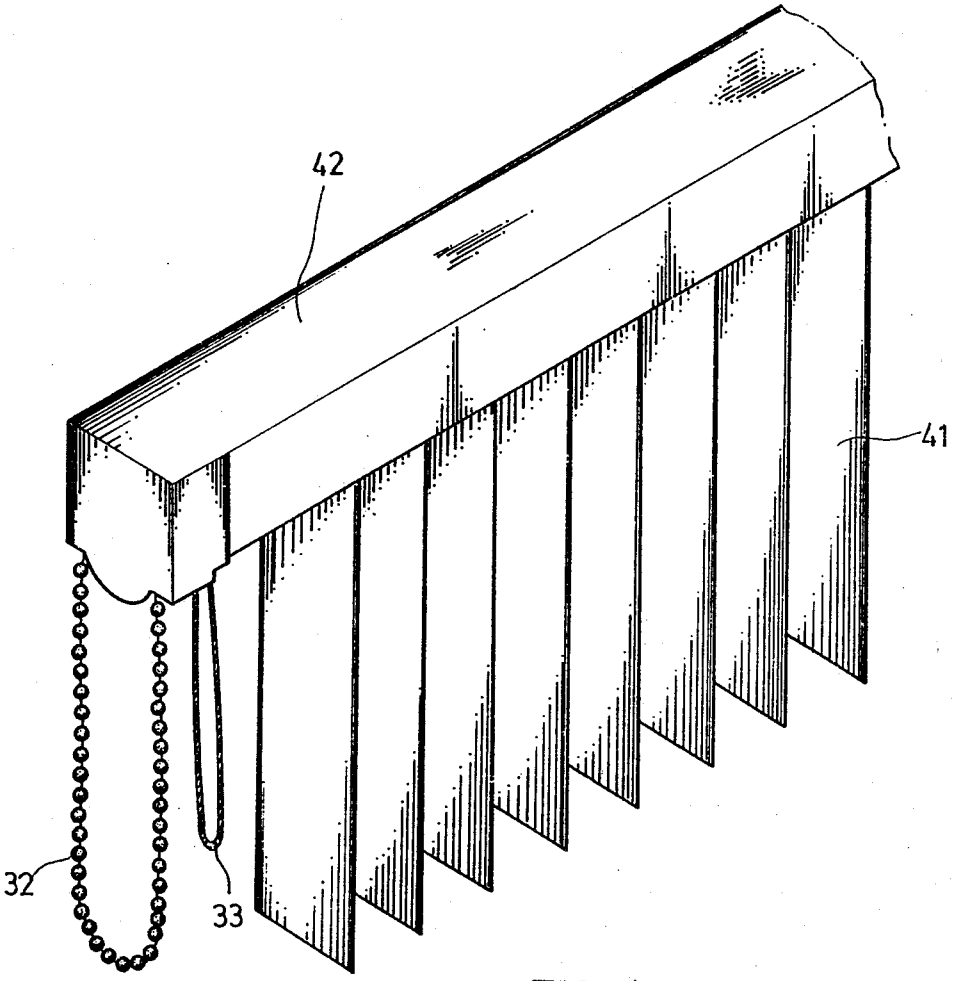
FIG. 1 is a perspective view of a regular Venetian blind.

Referring to FIG. 1, a regular Venetian blind includes a chain rope 32 to control the angular displacement of the blades 41, and a pull rope 33 to control the transverse displacement of the blades 41 on the sliding rail 42. Through the operation of the chain rope 32 and the pull rope 33, the Venetian blind is opened or closed.

Figure 2A:
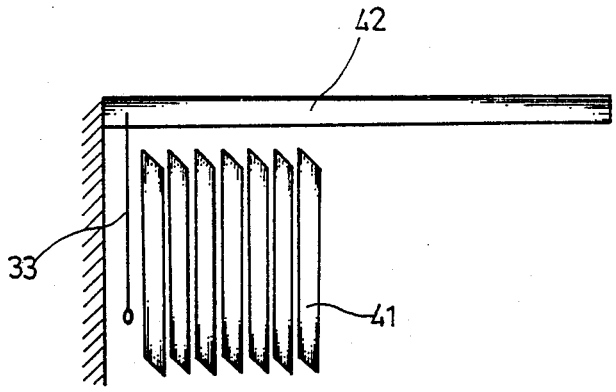
FIG. 2A is a schematic drawing of a regular Venetian blind wherein the blind blades are pulled to gather at one side to open the Venetian blind.
Figure 2B:
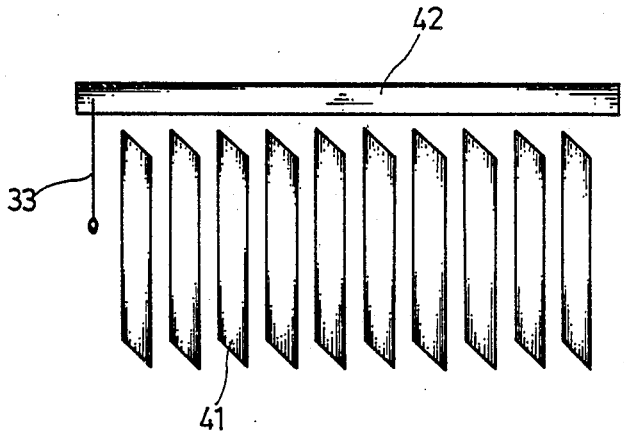
FIG. 2B is a schematic drawing of a regular Venetian blind, wherein the blind blades are pulled to spread out to close the Venetian blind.

Please refer to FIGS. 2A and 2B. FIG. 2A is a schematic drawing of a regular Venetian blind wherein the blind blades are pulled to gather at one side to open the Venetian blind, and FIG. 2B is a schematic drawing of a regular Venetian blind, wherein the blind blades are pulled to spread out to close the Venetian blind. Both the opening or closing of the Venetian blind is controlled by means of the pull rope 33.

Figure 3:
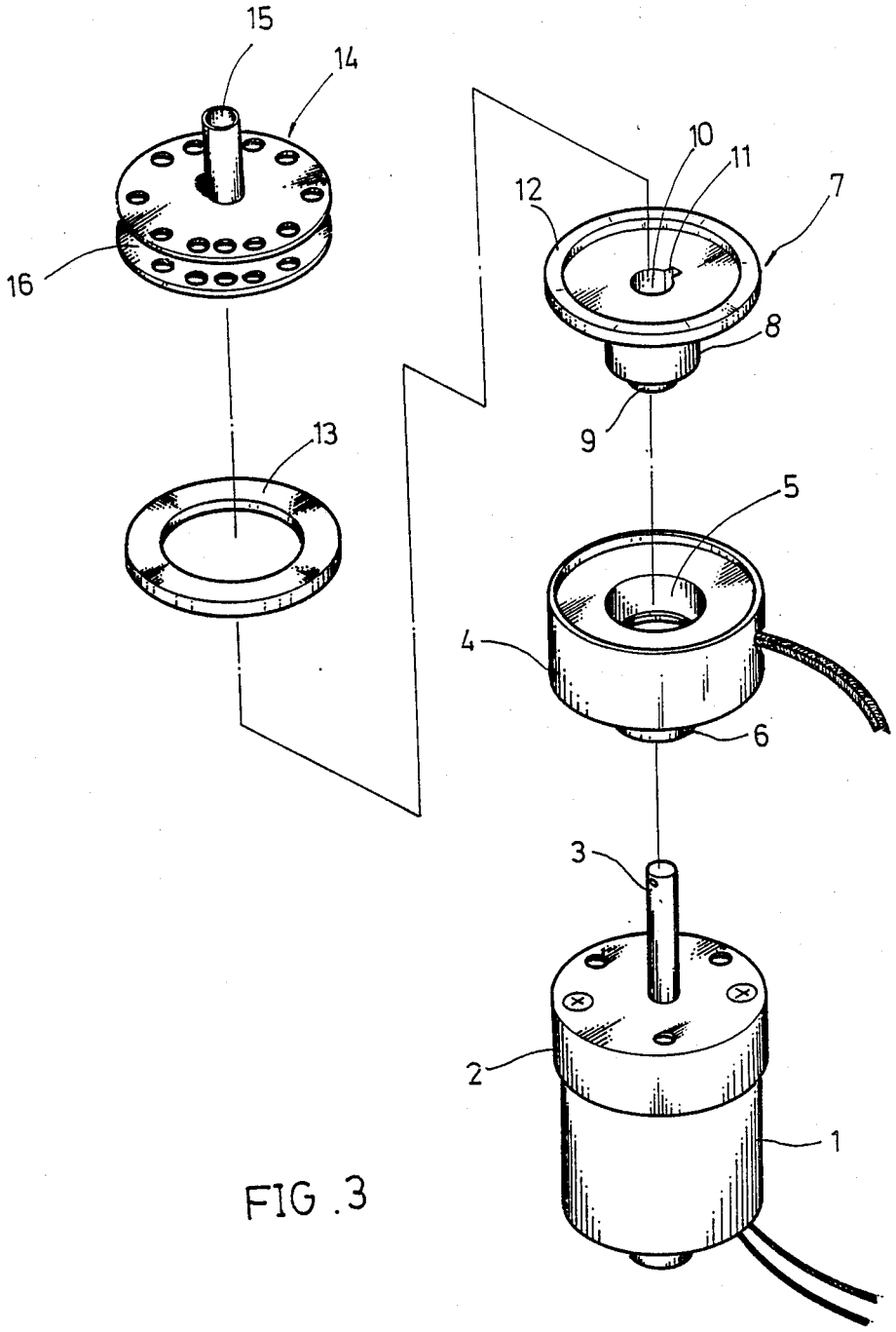
FIG. 3 is a fragmentary perspective view of the magnetic clutch fitted DC motor of the present invention.

Referring to the fragmentary perspective view of the magnetic clutch fitted DC motor of the present invention as shown in FIG. 3, the DC motor 1 includes a reducing gear 2 mounted on the top with the elongated shaft 3 of the motor 1 protruded upward at the center; a cylindrical electromagnetic coil 4 having a fish-eye-like central hole 5 with a bearing 6 firmly attached thereto at the bottom, being fixedly mounted on the top of said reducing gear 2 in a manner that said elongated shaft 3 is penetrated through said central hole 5 and firmly connected with the inner surface of said bearing 6; a revolving disc 7 having a bottom cylinder 8 comprising a flange 9 at the bottom end, a ring plate 12 made of paramagnetic material being mounted on the top, and a central piercing hole 10 with a pin holder 11 made thereon, said revolving disc 7 being mounted on said bearing 6 with said cylinder 8 set in said central hole 5 of said electromagnetic coil 4 and with said flange 9 arranged to be in contact with the inner surface of said bearing 6 of said electromagnetic coil 4, such that said elongated shaft 3 is penetrated through said central piercing hole 10 and fixedly connected with said revolving disc 7 by means of a pin (not shown) through said pin holder 11 so as to drive said revolving disc 7 to rotate concomitantly; a ring-shaped flat metal plate 13 made of paramagnetic material and directly stuck to the bottom end of a chain wheel 14 or a pull rope wheel 18; a chain wheel 14 comprising a central hole 15 for insertion therethrough of said elongated shaft 3, a circular groove 16 to carry a chain rope, and a plurality of round holes made at both sides of said circular groove 16. After said chain wheel 14 having been mounted on said elongated shaft 3, a pin 17 is provided to insert through the front end of said elongated shaft 3.

Figure 4:
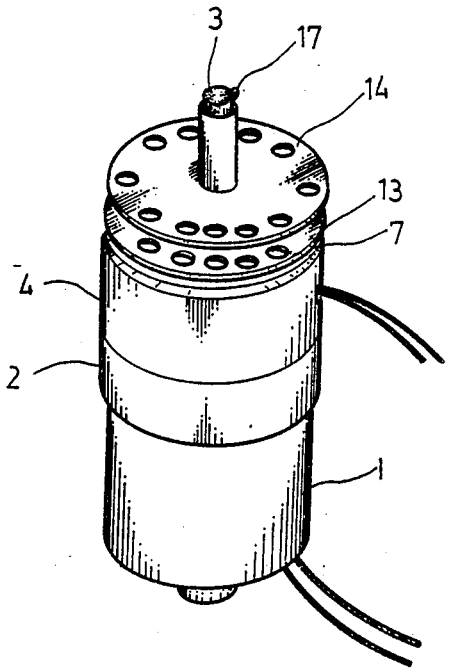
FIG. 4 is a perspective assembly view of the magnetic clutch fitted DC motor of the present invention.

Referring to the perspective assembly view of the magnetic clutch fitted DC motor of the present invention as shown in FIG. 4, the DC motor 1 is connected with the reducing gear 2 with the elongated shaft 3 upwardly protruded therebeyond. The revolving disc 7 is set in the fish-eye-like central hole 5 of the electromagnetic coil 4, the ring-shaped metal plate 13 is fixedly stuck to the chain wheel 14 and mounted on the revolving disc 7. The elongated shaft 3 penetrates through the electromagnetic coil 4, the revolving disc 7, the ring-shaped flat metal plate 13 and the chain wheel 14 with the pin 17 attached at the top end to retained the said component parts. In this arrangement, the chain wheel 14 may be replaced with a pull rope wheel 18. When the DC motor 1 is initiated, if the electromagnetic coil 4 is not energized by electric current, the motor will drives the revolving disc 7 to rotate; if the electromagnetic coil 4 is energized by electric current, the upper ring plate 12 of the revolving disc 7 will produce a magnetic force to attract the ring-shaped flat plate 13 such that the revolving disc 7, the ring-shaped flat plate 13 and the chain wheel 14 are simultaneously driven by the motor 1 to rotate. During power failure, the chain wheel 14 is free from the constraint of the motor 1 and can be pulled to rotate through manual operation by means of a chain rope.

Figure 5:
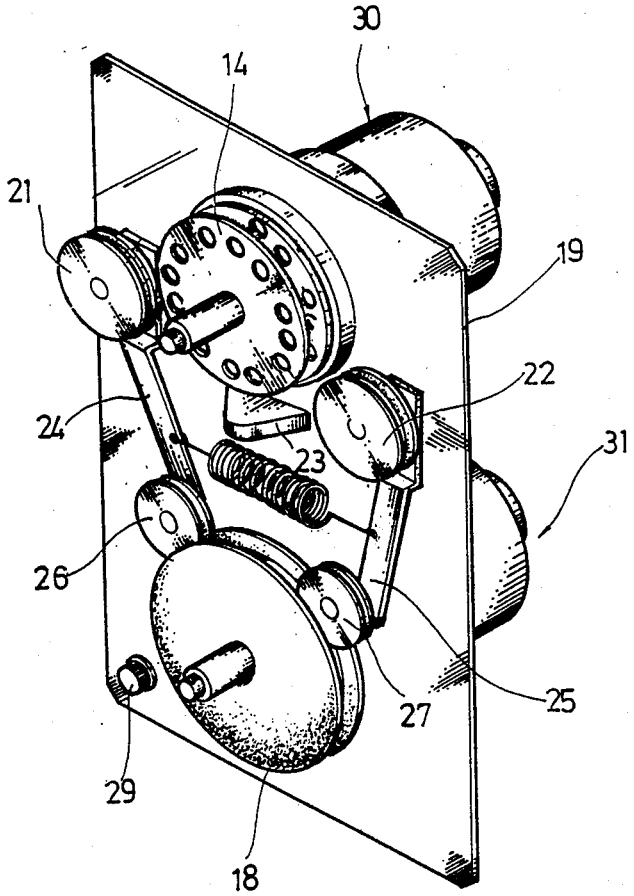
FIG. 5 is a perspective view of a Venetian blind controller embodying the present invention.

Referring to the perspective view of the preferred embodiment of the present invention as shown in FIG. 5, the casing 19 is made to provide two slots for fixedly setting therein of two electromagnetic clutch fitted DC motors 30 and 31 respectively. The motor 30 which is set at the upper position comprises a chain wheel 14, and the motor 31 which is set at the lower position comprises a pull rope wheel 18. There are provided two guide wheels 21 and 22 respectively made at both sides of the said chain wheel 14. Two rectangular plates 24 and 25 are respectively connected with the said two guide wheels 21 and 22 at one end, and with two pressure wheels 26 and 27 at the other end. A spring 28 is arranged to connect with said two rectangular plates 24 and 25 at both ends. The said pull rope wheel 18 of the said motor 31 is made of resilient rubber material. The said spring 28 pulls the said two pressure wheels 26 and 27 inward to let the said two pressure wheels 26 and 27 be respectively set in the circular groove of the said pull rope wheel 18 to press thereon so as to firmly retain a pull rope of any size in the said circular groove. The present embodiment also includes several circuit boards. There is also a fuse holder 29 made on the said casing 19.

Figure 6:
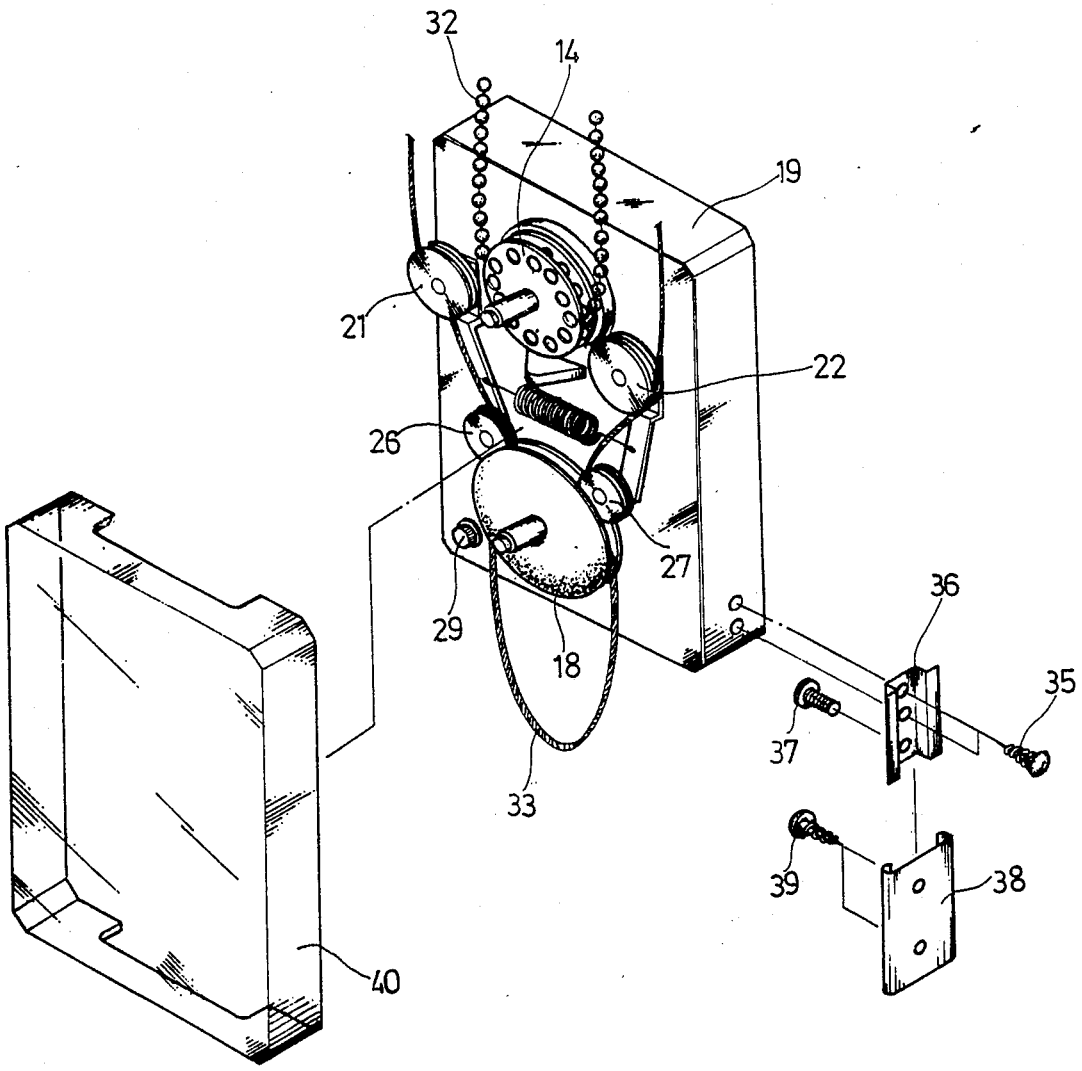
FIG. 6 is a schematic diagram of the preferred embodiment of the present invention, illustrating the arrangement of the pull rope.

Referring to FIG. 6, a chain rope 32 is mounted on the said channel wheel. A pull rope 33 is arranged to pass through the said guide wheels 21 and 22 and to mount on the said pull rope wheel 18 and be pressed down by the said pressure wheels 26 and 27 respectively at both sides. The loose portion of the said pull rope 33 is suspending from the said pull rope wheel 18. A-shaped inner fixing plate 36 is fixedly attached to the side wall of the said casing by means of a screw 35. A-shaped outer fixing plate 38 is fixedly attached to a window frame at a proper position by means of a screw 39. When in installation, the said inner fixing plate 36 is set in the said outer fixing plate 38 and screwed up with the said outer fixing plate 38 by means of another screw 37. A cover 40 is provided to cover the said casing 19.

Figure 7:
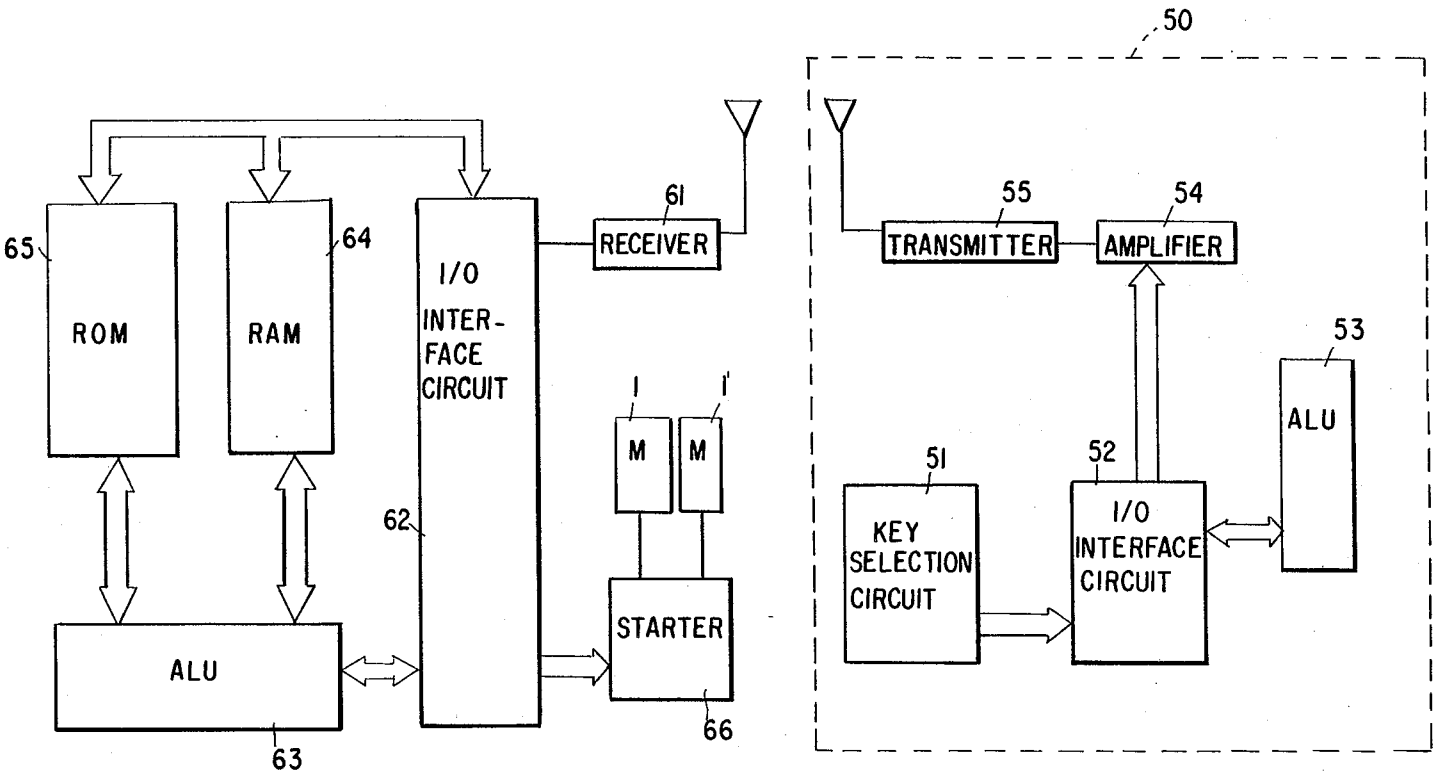
FIG. 7 is a circuit diagram for the preferred embodiment of the present invention.

Referring to the circuit diagram of FIG. 7, the remote controller 50 includes a key selection circuit 51, an I/O interface circuit 52, an ALU 53, an amplifier 54, and a transmitter 55. The said key selection circuit 51 is for selection of operation mode to let the signal be sent through said ALU 53, said I/O interface 52 to said amplifier 54 for amplification process, and be further transmitted through said transmitter 55. The transmitted signal from said transmitter 50 is further received by a receiver 61 to pass through an I/O interface circuit 62 to an ALU 63 for process. The said ALU 63 of the said receiver 61 is connected to RAM 64 and ROM 65 wherein a procedure of all operations is stored, and which read out the signal to energize a motor starter 66 through said I/O interface circuit 62, so as to drive the motors 1, 1' to rotate according to the mode selected through the said key selection circuit 51.

Figure 8:
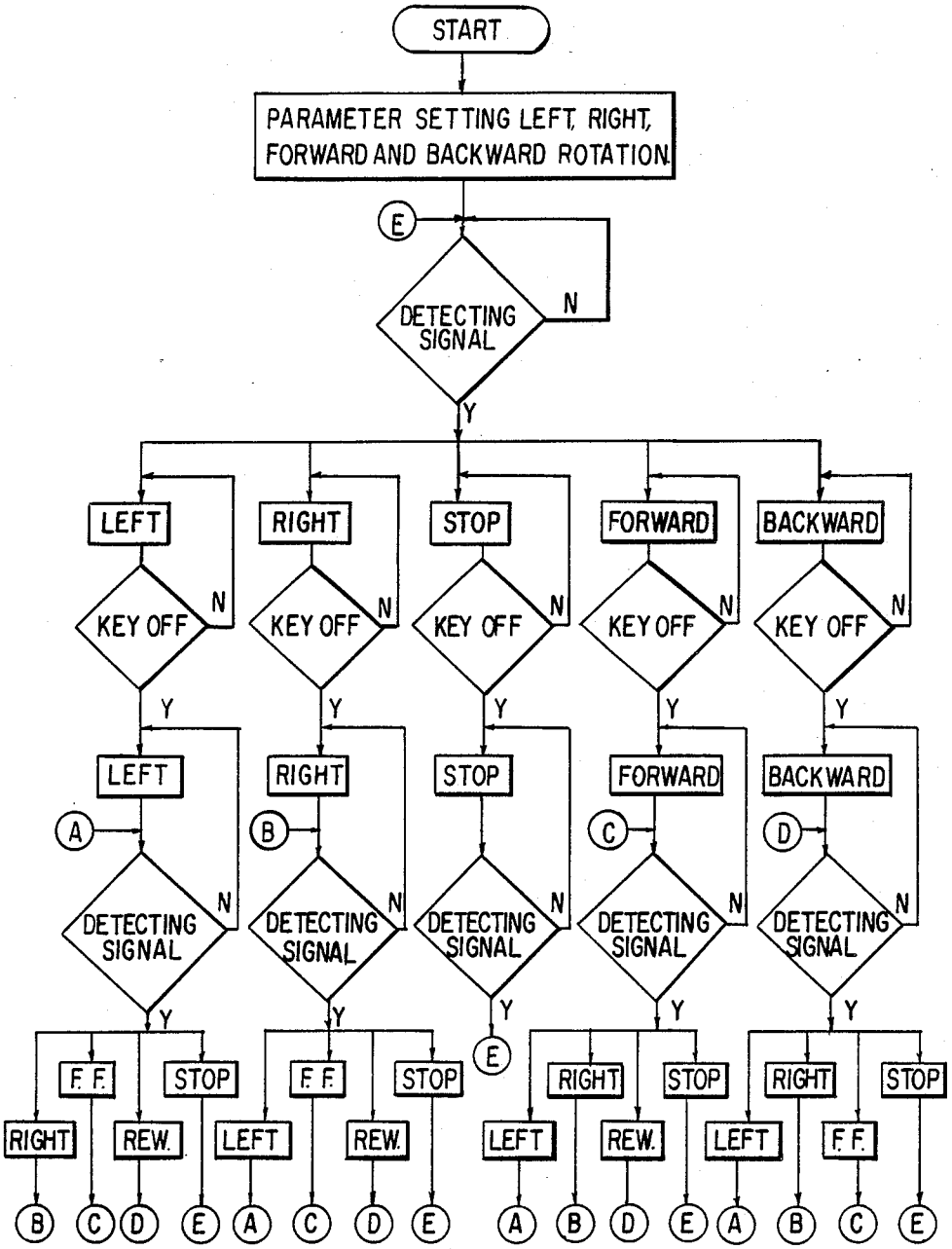
FIG. 8 is a flow chart for the preferred embodiment of the present invention.

Referring to the flow chart of FIG. 8, after initiation, it is to start parameter setting for left-handed, right-handed, forward, and backward rotation of the motors; then, it is to go through detection signal, and further, to get into different route of flow process for different action, and to control the operation of the motors or to stop the motors. The process is proceeded as follows:

(1) When started, the microprocessor keeps catching outside signals, including noises and the right infrared ray control codes. Because the microprocessor is designed to catch outside signals and to make judgment once per n milliseconds, it executes the operation unceasingly till the right signal is caught.

(2) If a right signal is provided after comparison, next judging step is proceeded according to the code caught. Upon first catching, it is counted for one to execute first job, that is, key scanning. Then, it is to return to primary signal catching point to repeat the operation for the second loop, and it will be counted for one time accordingly. As soon as the last loop is performed and counted, it will be reset to begin from the start.

(3) The key code judging is to identify the function of the code. For a stopping code, it will execute to stop the motor, and will then continuously detect if any new code to be executed. According to this circulation to form a loop.

(4) During the execution of each function in each loop, there are five by-passes to respectively check if any insertion of mode, so as to alternatively execute the instructions of stop, left, right, out, and return.

The Venetian blind controller of the present invention may be attached to any regular Venetian blinds or curtains which are controlled by means of pull rope, chain rope. When in inastallation, the outer fixing plate 38 is fixedly attached to a proper position on a window frame. The chain rope 32 is turned to mount on the chain wheel 14. The pull rope 33 is pressed between the pressure wheels 26 and 27 and the rull rope wheel 18.

Then, the inner fixing plate 36 is set in the outer fixing plate 38 to a right position for the screw 37 to screw up the casing 19 with the outer fixing plate 38. The cover 40 is then mounted on the casing 19 to enclose the controller. The key selection circuit 51 on the remote controller 50 is to remotely control the rotation of the chain wheel 14 and the pull rope wheel 18 so as to pull the chain rope 32 (which controls the angular displacement of the Venetian blind) and the pull rope 33 (which controls the opening or closing of the Venetian blind). Because of the arrangement of the electromagnetic coil 4 and the revolving disc 7, when circuit is off, the chain wheel 18 is released to rotate freely so as to allow hand control operation, that is, when electric power fails, the pull rope can be directly operated without having to remove the pull rope from the present controller. If a Venetian blind comprises two pull ropes instead of one pull rope and one chain rope, the chain wheel of the present Venetian blind controller may be replaced with a pull rope wheel so as to match with the Venetian blind.

We claim:

1. A venetian blind controller comprising:

two electromagnetic clutch fitted DC motors;

a casing and a cover, said casing having two holes for setting therein respectively said two DC motors, said cover encloses said casing;

a chain wheel fixedly mounted on an elongated shaft of one of said electromagnetic clutch fitted DC motors, and being positioned on the top of an electromagnetic coil, a circular groove for mounting thereon a chain rope, and a plurality of holes at both sides of said circular groove;

a pull rope wheel made of resilient rubber material, being fixedly mounted on an elongated shaft of the other electromagnetic clutch fitted DC motor, and being provided for mounting thereon on a pull rope of venetian blind;

two guide wheels pivotally mounted on said casing at both sides below said chain wheel;

two rectangular plates mounted on said casing and respectively connected with said two guide wheels at one end;

two pressure wheels mounted on said casing and respectively connected with the other end of said two rectangular plates;

a spring connecting said two rectangular plates at both ends to drive said two pressure wheels to press on said pull rope wheel;

a receiver circuit and a remote controller;

wherein said remote controller provides a signal to said receiver circuit to drive said electromagnetic clutch fitted DC motors, rotation of said motors drives said chain wheel or said pull rope wheel to move the chain rope or the pull rope of the venetian blind to control the closing and opening or the angular position of the blind blades.

2. A venetian blind controller according to claim 1, wherein said electromagnetic clutch fitted DC motors each comprises:

a reducing gear mounted on the top with the elongated shaft of the motor protruded upward at the center;

a cylindrical electromagnetic coil having a fish-eye-shaped central hole with a bearing firmly attached thereto at the bottom, and fixedly mounted on the top of said reducing gear in a manner that said elongated shaft is passed through said central hole and firmly connected with the inner surface of said bearing;

a revolving disc having a bottom cylinder and a flange at the bottom end, a ring plate member of paramagnetic material being mounted on the top, and a central piercing hole with a pin holder thereon, said revolving disc being mounted on said bearing with said cylinder set in said central hole of said electromagnetic coil and with said flange arranged to be in contact with the inner surface of said bearing of said electromagnetic coil;

a ring-shaped flat metal plate made of paramagnetic material and directly stuck to the bottom end of the chain wheel or the pull rope wheel;

said elongated shaft passes through said electromagnetic coil, said revolving disc, said ring-shaped flat metal plate and said chain wheel or said pull rope wheel and further being fixedly retained by a pin, said elongated shaft drives said revolving disc directly, and by energization of said electromagnetic coil to produce magnetic force to attract said ring-shaped flat metal plate, said elongated shalft also drives said chain wheel or said pull rope wheel.

3. A venetian blind controller according to claim 1, wherein said two pressure wheels are smaller than the circular groove of said pull rope wheel so as to be set in said circular groove to retain any pull rope of any size therebetween.

4. A venetian blind controller according to claim 1, wherein said chain wheel or said pull rope wheel is free from constraint of said electromagnetic coil to freely rotate during power off, allowing manual operation through the pull rope of the venetian blind.

5. A venetian blind controller according to claim 1, wherein said chain wheel is replaceable with another pull rope wheel so as to fit a conventional venetian blind or window blind.

6. A venetian blind controller according to claim 1, wherein said receiver circuit includes a receiver, an arithmetic logic unit, a random access memory (RAM), a read-only-memory (ROM), an I/O interface circuit, and a motor starter.

* * * * *